US008029365B2

(12) United States Patent
Burke et al.

(10) Patent No.: US 8,029,365 B2
(45) Date of Patent: Oct. 4, 2011

(54) HIERARCHICAL MULTI-TIERED SYSTEM FOR GAMING RELATED COMMUNICATIONS

(75) Inventors: Mary M. Burke, Somonauk, IL (US); Nevin J. Liber, Libertyville, IL (US); Mark B. Gagner, West Chicago, IL (US); Craig J. Sylla, Round Lake, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 315 days.

(21) Appl. No.: 11/277,064

(22) Filed: Mar. 21, 2006

(65) Prior Publication Data

US 2006/0217202 A1 Sep. 28, 2006

Related U.S. Application Data

(60) Provisional application No. 60/664,913, filed on Mar. 24, 2005, provisional application No. 60/700,940, filed on Jul. 20, 2005.

(51) Int. Cl.
*A63F 9/24* (2006.01)

(52) U.S. Cl. ..... 463/42; 463/40; 463/41

(58) Field of Classification Search ..... 463/40–42
See application file for complete search history.

(56) References Cited

U.S. PATENT DOCUMENTS

| | | | | |
|---|---|---|---|---|
| 5,759,102 | A * | 6/1998 | Pease et al. | 463/42 |
| 5,805,814 | A * | 9/1998 | Tsuda et al. | 725/36 |
| 5,848,064 | A * | 12/1998 | Cowan | 370/338 |
| 5,867,714 | A * | 2/1999 | Todd et al. | 717/172 |
| 5,951,639 | A * | 9/1999 | MacInnis | 725/70 |
| 6,199,204 | B1 * | 3/2001 | Donohue | 717/178 |
| 6,805,634 | B1 * | 10/2004 | Wells et al. | 463/42 |
| 6,944,788 | B2 * | 9/2005 | Dinker et al. | 714/4 |
| 2003/0061323 | A1 * | 3/2003 | East et al. | 709/223 |
| 2003/0188306 | A1 * | 10/2003 | Harris et al. | 717/174 |
| 2004/0005925 | A1 * | 1/2004 | Yamagishi | 463/40 |

* cited by examiner

*Primary Examiner* — Dmitry Suhol
*Assistant Examiner* — David Duffy
(74) *Attorney, Agent, or Firm* — Schwegman, Lundberg & Woessner, P.A.

(57) ABSTRACT

A system, apparatus and method for gaming-related communications in a hierarchical multi-tiered system are described herein. In some embodiments, a method includes transmitting a master configuration from a central operations of a hierarchical multi-tiered system to a local gaming site having one or more gaming components. The method also includes receiving a selected configuration for one or more of the gaming components based on the master configuration. The method includes downloading the selected configuration to the one or more of the gaming components through the hierarchical multi-tiered system.

18 Claims, 9 Drawing Sheets

HIERARCHICAL MULTI-TIERED SYSTEM FOR GAMING RELATED COMMUNICATIONS

RELATED APPLICATIONS

This application claims priority under 35 U.S.C. 119(e) from U.S. Provisional Application Ser. No. 60/664,913 filed Mar. 24, 2005, and from U.S. Provisional Application Ser. No. 60/700,940 filed Jul. 20, 2005, which applications are incorporated herein by reference.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, WMS Gaming, Inc.

BACKGROUND

1. Field

This invention relates generally to the field of network communications and more particularly to the field of communications over a network for gaming related communications.

2. Description of Related Art

Wagering game makers continually provide new and entertaining games. One way of increasing entertainment value associated with casino-style wagering games (e.g., video slots, video poker, video black jack, and the like) includes offering a base game and a variety of bonus events. However, despite the variety of bonus events, players often lose interest in repetitive gaming content. In order to maintain player interest, wagering game machine makers frequently update game themes, game settings, bonus events, and other gaming content.

In order to satisfy player demands, gaming machine operators continuously license and deploy new gaming content to gaming machines operating in the field. Gaming machine operators typically update gaming content by manually delivering updated gaming content to each gaming machine. For example, when a gaming machine's gaming content becomes undesirable or a license expires, an operator typically replaces existing media (e.g. ROM, CD-ROM, or flash RAM) with new media containing updated gaming and licensing content. For gaming machine operators owning scores of machines, this process can be laborious and expensive.

SUMMARY

A system, apparatus and method for gaming-related communications in a hierarchical multi-tiered system are described herein. In some embodiments, a method includes transmitting a master configuration from a central operations of a hierarchical multi-tiered system to a local gaming site having one or more gaming components. The method also includes receiving a selected configuration for one or more of the gaming components based on the master configuration. The method includes downloading the selected configuration to the one or more of the gaming components through the hierarchical multi-tiered system.

In some embodiments, a method includes executing an operation, by a component at a local gaming site, in response to a determination that a network link between the local gaming site and a central operations is disrupted. The operation is executable by the component at the local gaming site and executable by a component at the central operations.

In some embodiments, a method includes transmitting, from a central operations of a multi-tiered system, a request for one or more performance criteria to a gaming machine at a local gaming site. The method includes receiving a response that includes the one or more performance criteria from the gaming machine through the multi-tiered system. The method also includes transmitting a configuration update to the gaming machine through the multi-tiered system, if the one or more performance criteria are below a threshold.

In some embodiments, a system includes a central data store to store a master configuration for a number of gaming components at a local gaming site. The system also includes a central administration unit to transmit the master configuration to the local gaming site, wherein the central administration unit is to receive a selected configuration for one of the number of gaming components based on the master configuration.

In some embodiments, a system includes a gaming machine at a local gaming site. The system also includes a site controller to execute a scheduled operation related to the gaming machine, if a network link between the central operations and the local gaming site is disrupted. A component in a central operations is scheduled to execute the scheduled operation.

BRIEF DESCRIPTION OF THE FIGURES

The present invention is illustrated by way of example and not limitation in the Figures of the accompanying drawings in which.

DESCRIPTION OF THE EMBODIMENTS

Systems, apparatus and methods for gaming-related communications in a hierarchical multi-tiered system are described herein. This description of the embodiments is divided into three sections. The first section describes an example operating environment and system architecture. The second section describes example operations. The third section provides some general comments.

Hardware, Operating Environment, and System Architecture

This section provides an example system architecture in which embodiments of the invention can be practiced. This section also describes an example computer system and gaming machine. Operations of the system components will be described in the next section.

Example System Architecture

Figure 1:
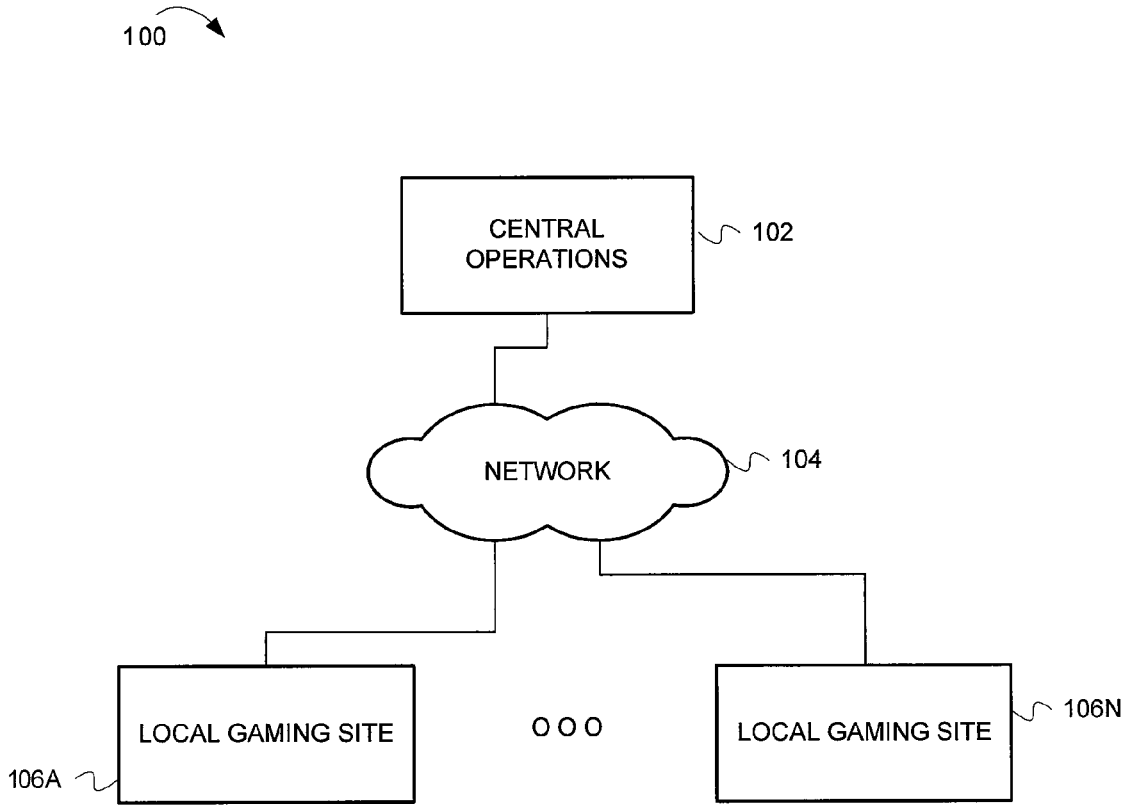
FIG. 1 illustrates a block diagram of a hierarchical multi-tiered system for gaming communications, according to some embodiments of the invention.

FIG. 1 illustrates a block diagram of a hierarchical multi-tiered system for gaming communications, according to some embodiments of the invention. The gaming communications may include download operations into different gaming components that are pare of the hierarchical multi-tiered system. The gaming communications may also include remote and central Administration, Operations and Maintenance (AOM) of these gaming components. These gaming communications may include download and upload operations through the hierarchical multi-tiered system.

As shown in FIG. 1, a system 100 includes a central operations unit 102, which is defined as an upper tier. The central operations unit 102 is coupled to a number of local gaming sites 106A-106N (which may be in different geographical locations) through a network 104. The local gaming sites 106 are in the lower tier of the system 100. The network 104 may be a wide area network (WAN), a local area network (LAN), etc. In some embodiments, the individual local gaming sites may be casinos, while the central operations unit 102 is in a remote location. Alternatively, the central operations unit 102 may be co-located with one or more of the local gaming sites 106.

Figure 2:
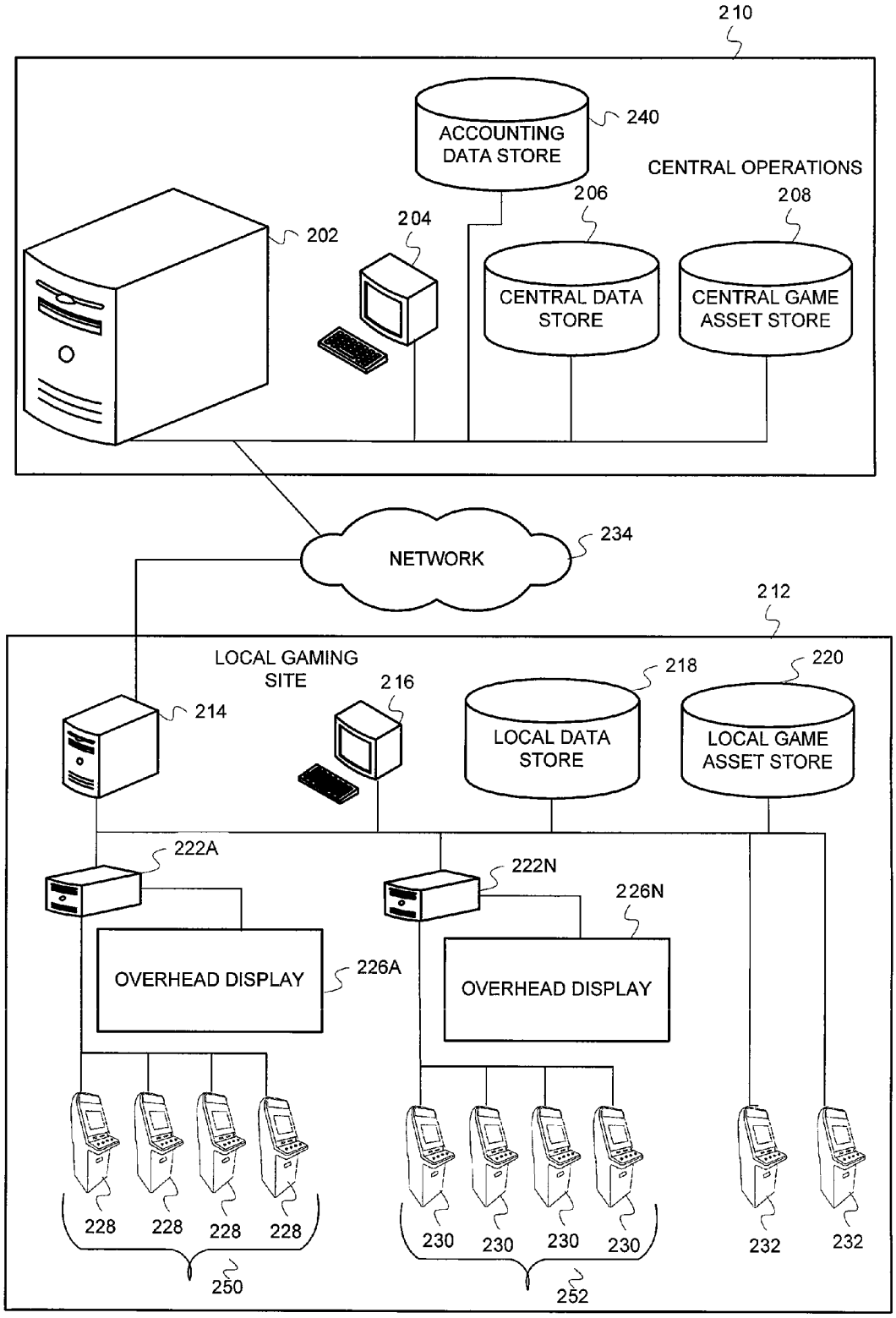
FIG. 2 illustrates a more detailed block diagram of parts of the hierarchical multi-tiered system for gaming communications, according to some embodiments of the invention.

An exemplary embodiment of the central operations unit 102 and one of the local gaming sites 106 is illustrated in FIG. 2, which is described in more detail below. The central operations unit 102 allows for central distribution and management of software downloads to the local gaming sites 106.

The central operations unit 102 may be configured to allow for shared access to central data stores by the multiple local gaming sites 106. The central operations unit 102 may process simultaneous requests from the multiple local gaming sites 106, while providing consistency in the data stored in the central data stores. In some embodiments, a profile of a player of the gaming machines may be maintained (independent of the location). As further described below, the central operations unit 102 may control and configure individual gaming components (such as gaming machines) within the system 100. The central operations unit 102 may also control and configure a group of individual gaming components (such as a bank of gaming machines).

The communications between the central operations unit 102 and the local gaming sites 106 may be based on a number of different protocols. For example, communications may be performed using one or more of a variety of communications protocols, including SAS (Slot Accounting System), SDS (Slot Data System), BOB (Best of Breed), WAP (Wide Area Progressive), LAP (Local Area Progressive), MICON, or other proprietary or non-proprietary protocols.

In alternate embodiments, one or more servers may provide multiple gaming services over a network using a common protocol. For example, a server may include a network interface that translates messages encoded using one or more proprietary protocols into messages encoded in a common protocol (e.g., TCP-IP, ATM, SLIP, PPP, a layer/protocol transmitted on top of TCP/IP, or some other protocol), which may or may not be proprietary. A gaming machine may have a corresponding network interface, which converts the network-received messages back into the corresponding proprietary protocols. The selection of the type of protocol may be configurable.

FIG. 2 illustrates a more detailed block diagram of parts of the hierarchical multi-tiered system for gaming communications, according to some embodiments of the invention. In particular, FIG. 2 illustrates a central operations unit 210 (that may be representative of the central operations unit 102) that is coupled to a local gaming site 212 (that may be representative of one of the local gaming sites 106) through a network 234.

In some embodiments, download operations, data warehousing and AOM operations may be performed within the individual local gaming sites 212. Alternatively or in addition, the central operations unit 210 may provide for distribution and management of the download operations. The central operations unit 210 may be used in the centralized licensing and centralized AOM operations.

The central operations unit 210 includes a server 202, a central administration unit 204, a central data store 206, a central game asset store 208 and an accounting data store 240, which are coupled together. The local gaming site 212 includes a site controller 214, a local administration unit 216, a local data store 218, a local game asset store 220, controllers 222A-222N, overhead displays 226A-226N, gaming machines 228, gaming machines 230 and gaming machines 232.

The gaming platform may include any component involved in the execution and presentation of game play. For example, the gaming platform may include the controllers 222, the overhead display 226 and the gaming machines 228, 230 and 232. The systems platform may include any component that is not directly involved in the execution or presentation of game play. For example, the systems platform may include the central game asset store 208, the local game asset store 220, the central administration unit 204, license servers (not shown in FIG. 2), etc.

In some embodiments, an installed version of system software for any of the components of the systems platform may be replaced with a newer version while maintaining usage of the existing database and assets. In some embodiments, the user is not required to enter new data or re-enter existing data to support the newer version of software. Moreover, the systems platform may provide a method to revert to the previous version of software.

The gaming machines 228 are part of a bank of machines 250. The gaming machines 230 are part of a bank of machines 252. In some embodiments, the controller 222A, the overhead display 226A and the bank of machines 250 are part of a progressive jackpot. Also, the server 202 may be a wide area progressive server. The overhead display 226A shows the current progressive jackpot amount. The controller 222A communicates with the gaming machines 228 and the overhead display 226A via any suit connection (e.g., a polled RS485 connection). In some embodiments, the controller 222A polls each gaming machine 228 at regular intervals and receives data from each gaming machine 228 in response to the query. In some embodiments, although the controller 222A can request data from the gaming machines 228, no hardware device or software application can affect any game outcome on any of the progressive gaming machines; only the gaming machine 228 determines the game outcome and the winner of a jackpot progressive. In other embodiments, the gaming machines 228 may be dumb terminals with the entire game play activity being coordinated and controlled by the server 202. In some embodiments, the controller 222N, the overhead display 226N and the bank of machines 252 are in a similar configuration.

In some embodiments, the central game asset store 208 may only store gaming content (to be distributed to the gaming components) that has been approved by the appropriate regulatory agency. In some embodiments, the data in the central game asset store 208 may only be added with regulatory approval. Also, modifications to such data are not allowed. The data to the central data store 206 may be added, modified and deleted without such regulatory approval. The central data store 206 may store records related to the different transactions performed in the hierarchy (requests for data, downloads, etc.). The accounting data store 240 may store data related to asset download and configuration operations for gaming components in the hierarchical multi-tiered system. Such data may be used for licensing revenue. For example, each time a game is played on a given gaming machine, revenue may be generated for the licensee.

The central administration unit 216 may provide configuration and download operations. For example, the central administration unit 216 may configure and download to devices that are part of the hierarchy.

The central administration unit 216 may provide an interface, such as a Graphical User Interface (GUI) display, in which the user controls/manages download operations and configures and manages the databases and database operations. The GUI may offer point-and-click operations, with graphics, pull-down menus, and dialogue boxes. The GUI may provide a graphical representation of both physical and logical devices of the system. In some embodiments, devices are represented hierarchically, allowing the user to easily drill up and down to devices. The user may be able to add modify, delete, and drag & drop devices on the GUI. Access to devices is also gained through drop down menus. The GUI may provide a visual indication of the status of each device. The interface may provide a web-based interface. In some embodiments, the user interface allows the operator to control/configure all of the gaming components in the largest of local gaming sites 212. The central administration unit 216 may provide a method of grouping gaming components so the operator may quickly drill down to a particular gaming component or group of such components. The central administration unit 216 may allow the user to drag and drop a configuration or a download to a gaming component.

The central administration unit 216 may provide a user interface to view the status of configuration operations in progress (including filtering and sorting based on these different configuration operations). The central administration unit 216 may provide a user interface to view the status of download operations in progress (including filtering and sorting based on these different download operations). The central administration unit 216 may also provide visual indications (e.g., color) to represent the status of an operation (including filtering and sorting based on these different download operations). The central administration unit 216 may provide visual and audible notification of unauthorized access to components in the system.

The central operations unit 210 may provide a number of authentication methods for access. In some embodiments, the methods may include a user identification/password, a smart card, digital certificates, etc. In some embodiments, the central operations unit 210 may include functional partitioning. Functional partitioning may restrict access to system functions based on the user's security level. For example, a first user may have a security level A, which allows such users to pre-configure devices but does not allow such users to execute the configuration. A second user may have a security level B (higher level), which allows such users to both pre-configure and execute the configuration. In some embodiments, the central operations unit 210 may include data partitioning. Data partitioning restricts access to specific assets based on the user's security level. For example, a first user may have access to read, modify and delete all game assets. A second user may have access to read all printer assets.

As further described below, in some embodiments, the central operations unit 210 may provide a rules-based engine. Specifically, the central operations unit 210 may provide a method for the user to define, test, modify, and execute rules based on transaction management, operational workflow, and data management. The rules-based engine may be used for configuration management, fault management, and performance management functions. The rules may be executable on-demand or scheduled.

In some embodiments, components of the systems platform (such as the central administration unit 204) may synchronize the data stored in the central data store 206 and the local data store 218 with the configurations of the gaming components in the system. For example, the central administration unit 204 may transmit a request to all or some of the gaming components for their configurations. If the configurations of the gaming components do not match the records in the central data store 206 and the local data store 218, the central administration unit 204 may update these records. Synchronization may be performed on a scheduled basis, an on-demand basis, for a single component, for a group of non-contiguous components, etc.

The local data store 218 may serve as a local cache for the central data store 206. Similarly, the local game asset store 220 may serve as a local cache for the central game asset tore 208. In some embodiments, the local data store 218 and the local game asset store 220 may serve as a local cache for data that is related to its local gaming site 106. Accordingly, the local data store 218 and the local game asset store 220 at a local gaming site (e.g., casino) only store data related gaming components at this particular local gaming site. Therefore, one casino is not able to store data related to gaming components at a different casino. In some embodiments, some local gaming sites may share data. For example, some casinos may share if there is a same ownership. Alternatively, in some embodiments, the local data store 218 and the local game asset store 220 may store the data from across more than one local gaming site. In some embodiments, the data stored therein may be shared among the local gaming sites with limitations. For example, the data may be shared such that the origin of the data is not disclosed. Accordingly, it may be disclosed that a gaming machine executing a particular game is generating a certain level of revenue. However, it may not be disclosed at which particular local gaming site, the gaming machine is located.

In some embodiments, the local data store 218 and the local game asset store 220 may operate in a Redundant Array of Independent Disks (RAID) configuration. If a download operation is such that it may only occur as a background operation that does not affect or prevent continued game play, a RAID configuration may not be required. If a download operation may be such that downloads may occur on demand and where such downloads are critical to continued game play, a RAID configuration may be required to provide redundancy.

The local game asset store 220 and the central game asset store 208 may be capable of storing all games assets for a number of unique themes and games, which may include video clips in addition to the game asset files. Data may be added to the local game asset store 220 using physical media (such as a Digital Video Disk (DVD) or by downloading such data from the central game asset store 208. Data may be added to the central game asset store 208 using physical media. Also, data may be added to the central game asset store 208 through a download operation from a secure facility (e.g., a secured server at a remote location). In some embodiments, each game asset added to the central game asset store 208 may be tagged to indicate for which jurisdiction(s) there is approval.

In some embodiments, the downloading of data into the local game asset store 220 may be conducted in accordance with the standards of the regulatory body in which the local gaming site 106 resides. In some embodiments, the different gaming communications (such as the downloading of data) among the components of the central operations unit 210 and the components of the local gaming sites 212 may require certain levels and types of encryption, the use of digital certificates, etc. In some embodiments, IPSec (Internet Protocol Security) may be used for network encryption and authentication. Further information concerning IPSec may be obtained from *IPSec The New Security Standard for the Internet*, Naganand Doraswamy and Dan Harkins, Prentice Hall, 1999, which is incorporated herein by reference in its entirety.

In some embodiments, only game assets that have been approved by the target jurisdiction (in which the local gaming site 212 resides) may be downloaded into the local game asset store 220. The download operation of a game asset may be required to be independent of a separate download operation of a different game asset. Accordingly, each download operation may be independently verified in accordance with the gaming regulations. The central game asset store 208 may store current and historical content for multiple jurisdictions and may store all game assets for the different versions of all themes.

In some embodiments, certain components of the systems platform (e.g., the central administration unit 204) may filter, sort and search the records in the central data store 206 and the local data store 218. Such results may be viewed and printed. Rules (based on the rules-based engine) may be used to define and execute sequences of operations based on the records stored in the central data store 206, the local data store 218, the central game asset store 208 or the local game asset store 220. The central administration unit 204 may initiate operations (such as a download) based on thresholds defined by the rules.

The central data store 206, the local data store 218, the central game asset store 208 or the local game asset store 220 may be configured as redundant platforms. In some embodiments, record locking is incorporated into the central data store 206, the local data store 218, the central game asset store 208 and the local game asset store 220. For example, only one gaming component (such as a gaming machine) may access, at a given time, a record stored in the local data store 218 and the local game asset store 220. Only one local gaming site 212 may have ownership of a particular record, at a given time, stored in the central data store 208 and the central game asset store 208.

In some embodiments, if a gaming component attempts to access a record that is not stored in the local data store 218 or the local game asset store 220, the gaming component may access the record in the central data store 206 or the local game asset store 220. If a gaming component updates a record in the local data store 218, the local administration unit 216 may update the corresponding record in the central data store 206.

In some embodiments, the central administration unit 204 may allow a user to view the data stored in the local game asset store 220 and the central game asset store 208 and delete data that is no longer required. Additionally, the central administration unit 204 may allow a user to view data currently on a gaming component and delete data that is no longer required.

In some embodiments, the central administration unit 204 may generate a log entry in the local game asset store 220 and the central game asset store 208 after a gaming component is added, removed or altered in the local game asset store 220 and the central game asset store 208, respectively. The log entry may contain the date and time of the operation, identification of the particular component or file affected, identification of the person or entity performing the operation, the reason for the operation and any relevant validation/authentication information.

In some embodiments, the central administration unit 204 may generate a log entry after a configuration of a gaming component is altered. This log entry may contain the date and time of the operation, configuration state prior to the modification, configuration state after the modification, identification of the person or entity performing the operation, the identity of the gaming component(s), the reason for the operation and any relevant validation/authentication information.

The central administration unit 204 may also generate a log entry after component/file is downloaded to a gaming component. This log entry may contain the date and time of the operation, identification of the particular component or file affected, identification of the person or entity performing the operation, the reason for the operation and any relevant validation/authentication information. In some embodiments, all log entries are maintained on a separate system that is not physically or logically accessible to the person or entity performing the operation.

The central administration unit 204 may generate a log entry after a component is downloaded to a local gaming site 106 (from the central game asset store 208). This log entry may contain the date and time of the operation, identification of the particular component or file affected, identification of the person or entity performing the operation, the reason for the operation, the identity of the local gaming site 106 and any relevant validation/authentication information. In some embodiments, such log entries are stored in the central data store 206 for a predetermined time period. Alternatively, such log entries may not be deleted. Rather, these log entries may be permanently archived in the central data store 206 and/or a separate data store.

The gaming machines 232 may be representative of individual gaming machines (that are independent of a bank). The site controller 214 is coupled to components of the central operations unit 210 through the network 234. The site controller 214, the local administration unit 216, the local data store 218, the local game asset store 220, the controllers 222A-222N and the gaming machines 232 are coupled together. For example, the site controller 214, the local administration unit 216, the local data store 218, the local game asset store 220, the controllers 222A-222N and the gaming machines 232 may be coupled together through a LAN.

The controller 222A is coupled to the overhead display 226A and the gaming machines 228. The controller 222N is coupled to the overhead display 226N and the gaming machines 230. The controllers 222 may be representative of carousel controllers, overhead display controllers, game controllers, etc.). As shown, the site controller 214 may link together a number of controllers 222 and individual gaming machines. As further described below, data is uploaded from and downloaded into different parts of the gaming platform from the central operations unit 210.

At times, communications (e.g., the network link) between the central operations 210 and the local gaming sites 212 may be disrupted. In some embodiments, the local gaming site 212 may operate independent of the central operations 210. For example, if the network connection there between was lost, the local gaming site 212 may continue operations. Therefore, if data is typically uploaded into the central data store 206 (as described in operations below), such data is stored in the local data store 218. This data may subsequently be uploaded to the central data store 206 after the network connection is restored.

During a disruption, some operations may not be performed with a complete confidence. Therefore, queries from client applications (such as those on the gaming machines) are flagged with an indication that the system is operating in a disruption mode. For example, if a client application attempts to lock data records in the local data store 218 or the local game asset store 220, the attempts are flagged with this indication. In some embodiments, the client application must determine if a given operation may be performed during this disruption. In some embodiments, the gaming machines perform an operation in response to determining that the system is operating in a disruption mode. For example, the gaming machine may perform an operation to move the gaming machine to an out of service state. The gaming machine may cause certain games to be unplayable thereon during this disruption mode. As a further example, the gaming machine may store data related to game play during this disruption mode. Such data may be subsequently logged at the central operations unit 210.

A critical system component may include any hardware or software component that is critical to continued gaming operations for more than a single gaming component (such as a gaming machine). In other words, a critical system component may be a hardware or software component, which, upon failure, would force multiple gaming components to become unplayable. According to some gaming regulations, any critical system component that serves more than 64 gaming components is to be configured such that any single point failure will not result in more than 50% of the associated gaming components being disabled. Based on such regulations, in some embodiments, critical system components that serve more than 64 gaming components are implemented in a redundant manner. In some embodiments, if a software download is implemented in a manner where the download only occurs in background operations and does not affect or prevent continued game play, then the software download feature and its associated components are not considered to be critical. If a software download is implemented in a manner where downloads may occur on demand and where such downloads are critical to continued play, then the software download feature and its associated components may be considered to be critical.

Fault Management

In some embodiments, components of the systems platform (such as the central administration unit 216) may provide a fault management function for the network and the devices in the system 100 to identify errors/conditions and may correct such errors. Fault management operations may include (1) the ability to detect, isolate, report, and correct malfunctions in the devices and network system, (2) the ability to detect changes in the network, (3) the ability to notify the user of errors and conditions, the ability to log and maintain errors and conditions, (4) the ability for the user to dynamically view faults in both a single view (window) and graphical representation of the network and devices, (5) the ability to visually depict the status and severity of errors in the views and graphical representations, (6) the ability for the user to filter, search, and sort on the errors and conditions, (7) a method to manage fault tracking and error and condition status, (8) the ability for the user to identify, localize, trace, and correct errors, (9) the ability to perform sequences of diagnostics and tests on devices and print a report of the results, (10) the ability to for the user to isolate problems by correlating multiple errors, events, and conditions, etc.

Infrastructure and Network Performance Management

In some embodiments, components of the systems platform (such as the central administration unit 204) may provide infrastructure and network performance for the network and the devices in the system 100. Infrastructure and network performance may include (1) the ability to evaluate and report on the effectiveness of the infrastructure, (2) the ability to collect performance statistics on the infrastructure, including but not limited to throughput, availability, latency, link performance, and connectivity, (3) the ability to maintain and log the performance statistics, (4) the ability for the user to dynamically view the statistics in both a view (window) and graphical representation of the network and devices, (5) the ability for the user to define rules to set and trigger threshold conditions that notify the user of performance related conditions in the system, (6) the ability for the user to use rules to define operational and performance conditions of the devices and network that trigger alerts that notify the user of possible malfunctions, (7) the ability to isolate performance related problems by correlating multiple errors, conditions, and events, (8) a method to snapshot the performance of the infrastructure for troubleshooting purposes, (9) a method to analyze previous performance snapshots and identify performance trends, (10) the ability for the user to view and print reports of performance trends, (11) a method to model and simulate the network to determine optimal performance, (12) a method to identify and resolve intermittent failures in the infrastructure, etc.

In some embodiments, components of the systems platform may provide gaming component preventative maintenance operations. Such operations may include the ability to monitor the activities of a gaming component and proactively notify the user of potential problems with the gaming component. For example, a notification may be made via a pager number, emails, etc. Another operation may include the ability to monitor the activities of the gaming component to identify trends in repair.

Example Computer System and Gaming Machine

Figure 3:
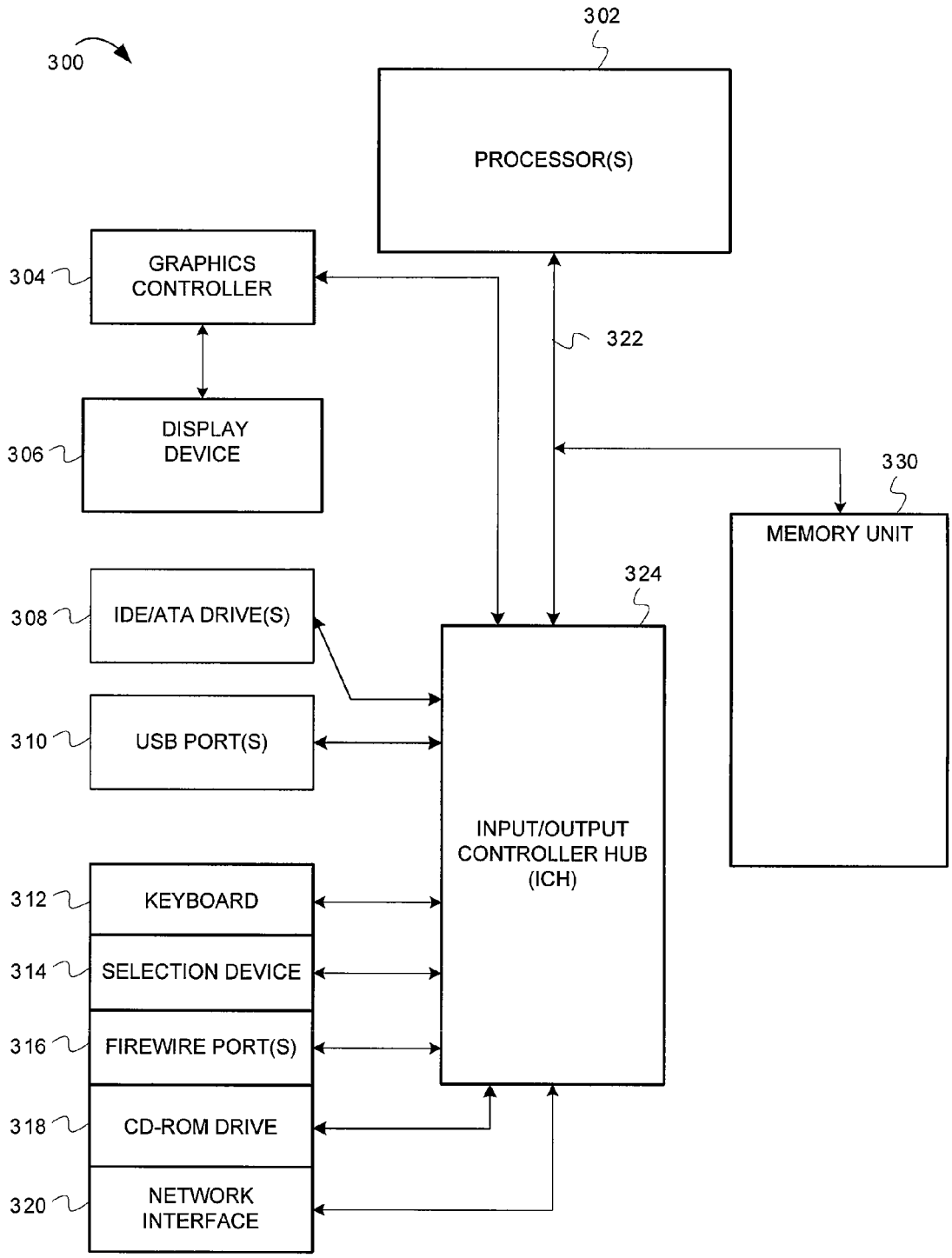
FIG. 3 illustrates a computer device that executes software for performing operations related to gaming-related communications in a hierarchical multi-tiered system, according to some embodiments of the invention.

FIG. 3 illustrates a computer device that executes software for performing operations related to gaming-related communications in a hierarchical multi-tiered system, according to some embodiments of the invention. The computer system 300 may be representative of various components in the system 200. For example, the computer system 300 may be representative of the central administration unit 204, the local administration unit 216, the server 202, the controllers 222, any of the gaming machines, etc.

As illustrated in FIG. 3, the computer system 300 comprises processor(s) 302. The computer system 300 also includes a memory unit 330, processor bus 322, and Input/Output controller hub (ICH) 324. The processor(s) 302, memory unit 330, and ICH 324 are coupled to the processor bus 322. The processor(s) 302 may comprise any suitable processor architecture. The computer system 300 may comprise one, two, three, or more processors, any of which may execute a set of instructions in accordance with embodiments of the invention.

The memory unit 330 may store data and/or instructions, and may comprise any suitable memory, such as a dynamic random access memory (DRAM). The computer system 300 also includes IDE drive(s) 308 and/or other suitable storage devices. A graphics controller 304 controls the display of information on a display device 306, according to some embodiments of the invention.

The input/output controller hub (ICH) 324 provides an interface to I/O devices or peripheral components for the computer system 300. The ICH 324 may comprise any suitable interface controller to provide for any suitable communication link to the processor(s) 302, memory unit 330 and/or to any suitable device or component in communication with the ICH 324. For one embodiment of the invention, the ICH 324 provides suitable arbitration and buffering for each interface.

For some embodiments of the invention, the ICH 324 provides an interface to one or more suitable integrated drive electronics (IDE) drives 308, such as a hard disk drive (HDD) or compact disc read only memory (CD ROM) drive, or to suitable universal serial bus (USB) devices through one or more USB ports 310. For one embodiment, the ICH 324 also provides an interface to a keyboard 312, a mouse 314, a CD-ROM drive 318, one or more suitable devices through one or more firewire ports 316. For one embodiment of the invention, the ICH 324 also provides a network interface 320 though which the computer system 300 can communicate with other computers and/or devices.

In some embodiments, the computer system 300 includes a machine-readable medium that stores a set of instructions (e.g., software) embodying any one, or all, of the methodologies for described herein. Furthermore, software may reside, completely or at least partially, within memory unit 330 and/or within the processor(s) 302.

Figure 4:
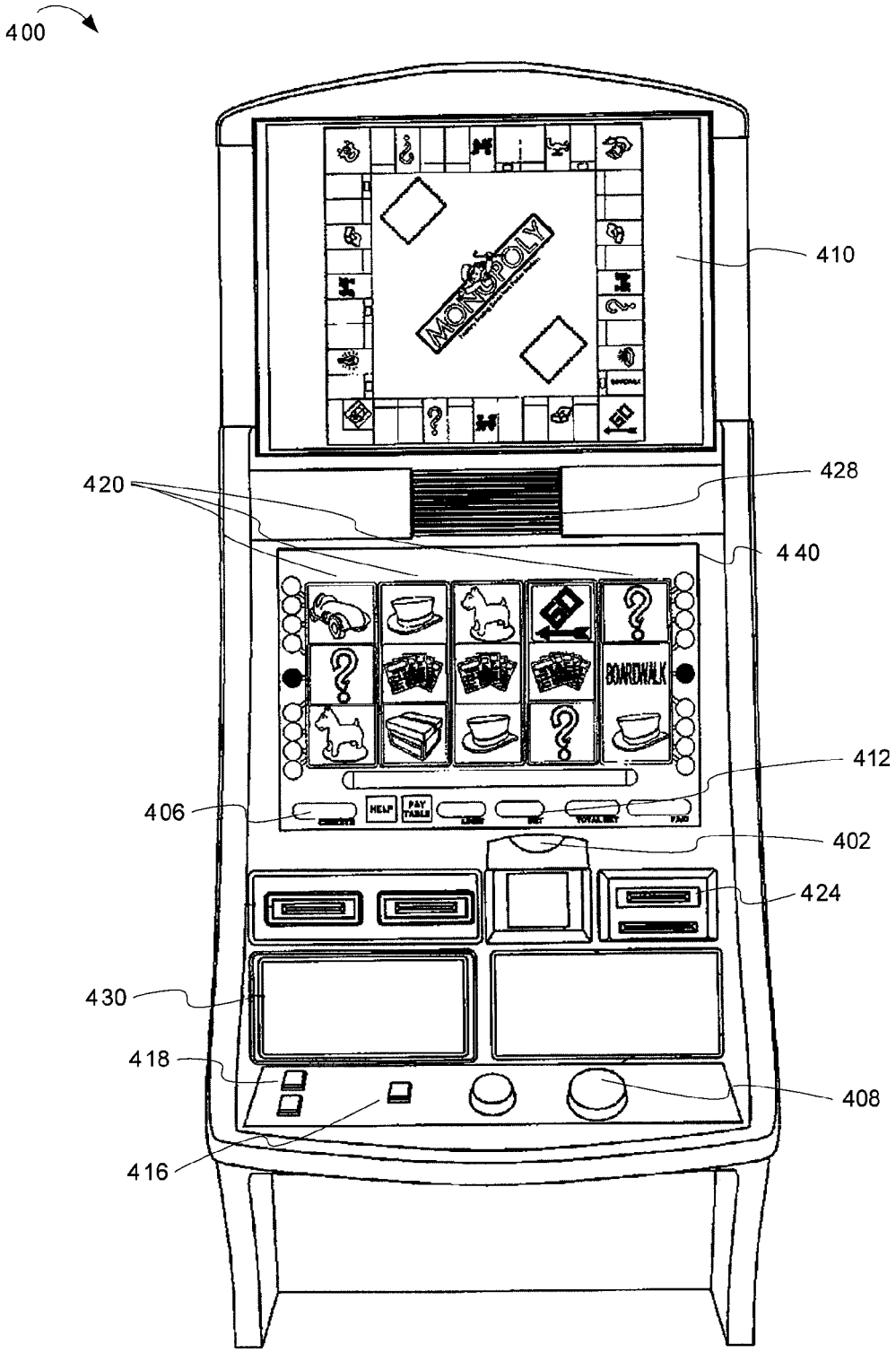
FIG. 4 is a perspective view of a gaming machine, according to some embodiments of the invention.

While FIG. 3 describes a computer system that may be used in conjunction with embodiments of the invention, FIG. 4 describes embodiments of a gaming machine that may be used with embodiments of the invention.

FIG. 4 is a perspective view of a gaming machine, according to exemplary embodiments of the invention. As shown in FIG. 4, the gaming machine 400 can be a computerized slot machine having the controls, displays, and features of a conventional slot machine.

The gaming machine 400 can be operated while players are standing or seated. Additionally, the gaming machine 400 is preferably mounted on a stand (not shown). However, it should be appreciated that the gaming machine 400 can be constructed as a pub-style tabletop game (not shown), which a player can operate while sitting. Furthermore, the gaming machine 400 can be constructed with varying cabinet and display designs. The gaming machine 400 can incorporate any primary game such as slots, poker, or keno, and additional bonus round games. The symbols and indicia used on and in the gaming machine 400 can take mechanical, electrical, or video form.

As illustrated in FIG. 4, the gaming machine 400 includes a coin slot 402 and bill acceptor 424. Players can place coins in the coin slot 402 and paper money or ticket vouchers in the bill acceptor 424. Other devices can be used for accepting payment. For example, credit/debit card readers/validators can be used for accepting payment. Additionally, the gaming machine 400 can perform electronic funds transfers and financial transfers to procure monies from financial accounts. When a player inserts money in the gaming machine 400, a number of credits corresponding to the amount deposited are shown in a credit display 406. After depositing the appropriate amount of money, a player can begin playing the game by pushing play button 408. The play button 408 can be any play activator used for starting a wagering game or sequence of events in the gaming machine 400.

As shown in FIG. 4, the gaming machine 400 also includes a bet display 412 and a "bet one" button 416. The player places a bet by pushing the bet one button 416. The player can increase the bet by one credit each time the player pushes the bet one button 416. When the player pushes the bet one button 416, the number of credits shown in the credit display 406 decreases by one credit, while the number of credits shown in the bet display 412 increases by one credit.

A player may "cash out" by pressing a cash out button 418. When a player cashes out, the gaming machine 400 dispenses a voucher or currency corresponding to the number of remaining credits. The gaming machine 400 may employ other payout mechanisms such as credit slips (which are redeemable by a cashier) or electronically recordable cards (which track player credits), or electronic funds transfer.

The gaming machine also includes a primary display unit 404 and a secondary display unit 410 (also known as a "top box"). The gaming machine may also include an auxiliary video display 440. In one embodiment, the primary display unit 404 displays a plurality of video reels 420. According to embodiments of the invention, the display units 404 and 410 can include any visual representation or exhibition, including moving physical objects (e.g., mechanical reels and wheels), dynamic lighting, and video images. In one embodiment, each reel 420 includes a plurality of symbols such as bells, hearts, fruits, numbers, letters, bars or other images, which correspond to a theme associated with the gaming machine 400. Furthermore, as shown in FIG. 4, the gaming machine 400 includes an audio presentation unit 428. The audio presentation unit 428 can include audio speakers or other suitable sound projection devices.

System Operations

This section describes operations performed by embodiments of the invention. In certain embodiments, the operations are performed by instructions residing on machine-readable media (e.g., software), while in other embodiments, the methods are performed by hardware or other logic (e.g., digital logic).

Figure 5:
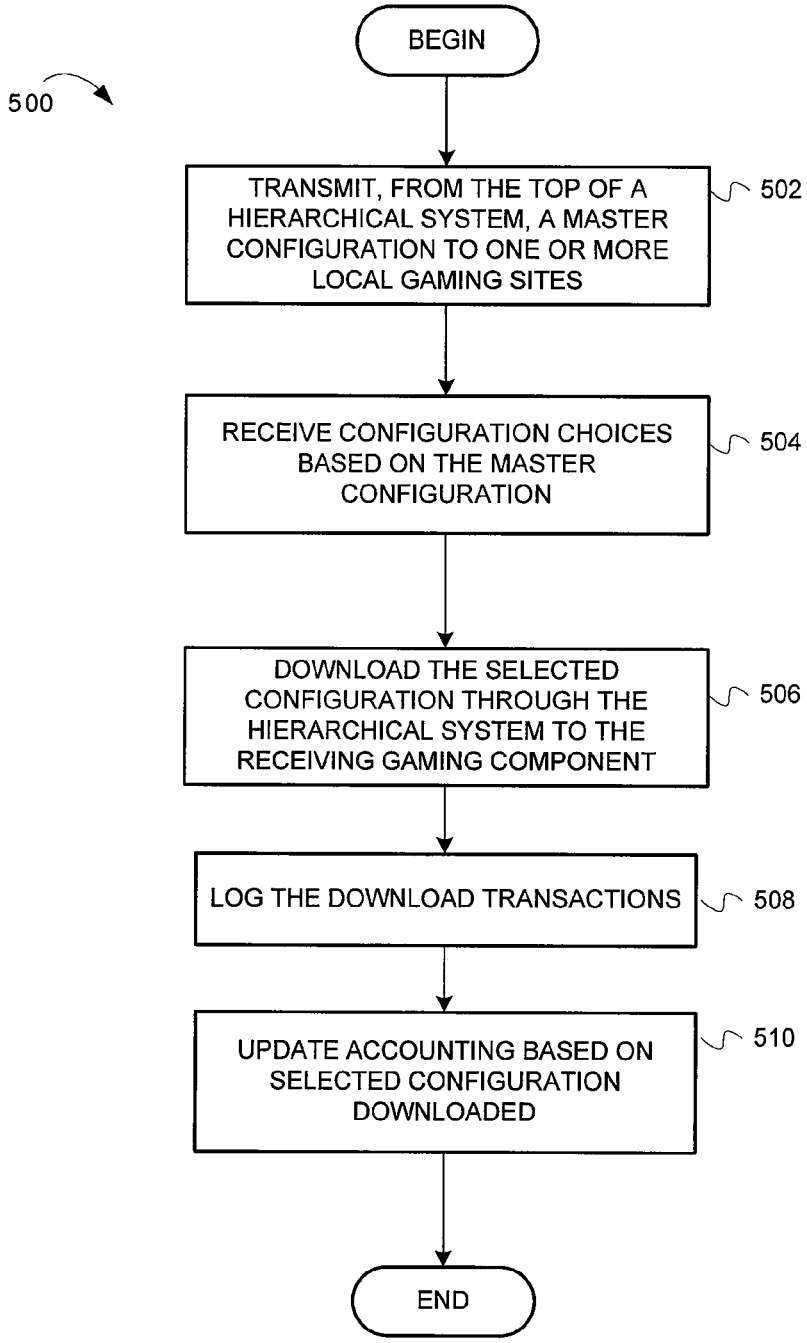
FIG. 5 illustrates a flow diagram for operations for distributing of configuration data to gaming components in a hierarchical multi-tiered system, according to some embodiments of the invention.
Figure 6:
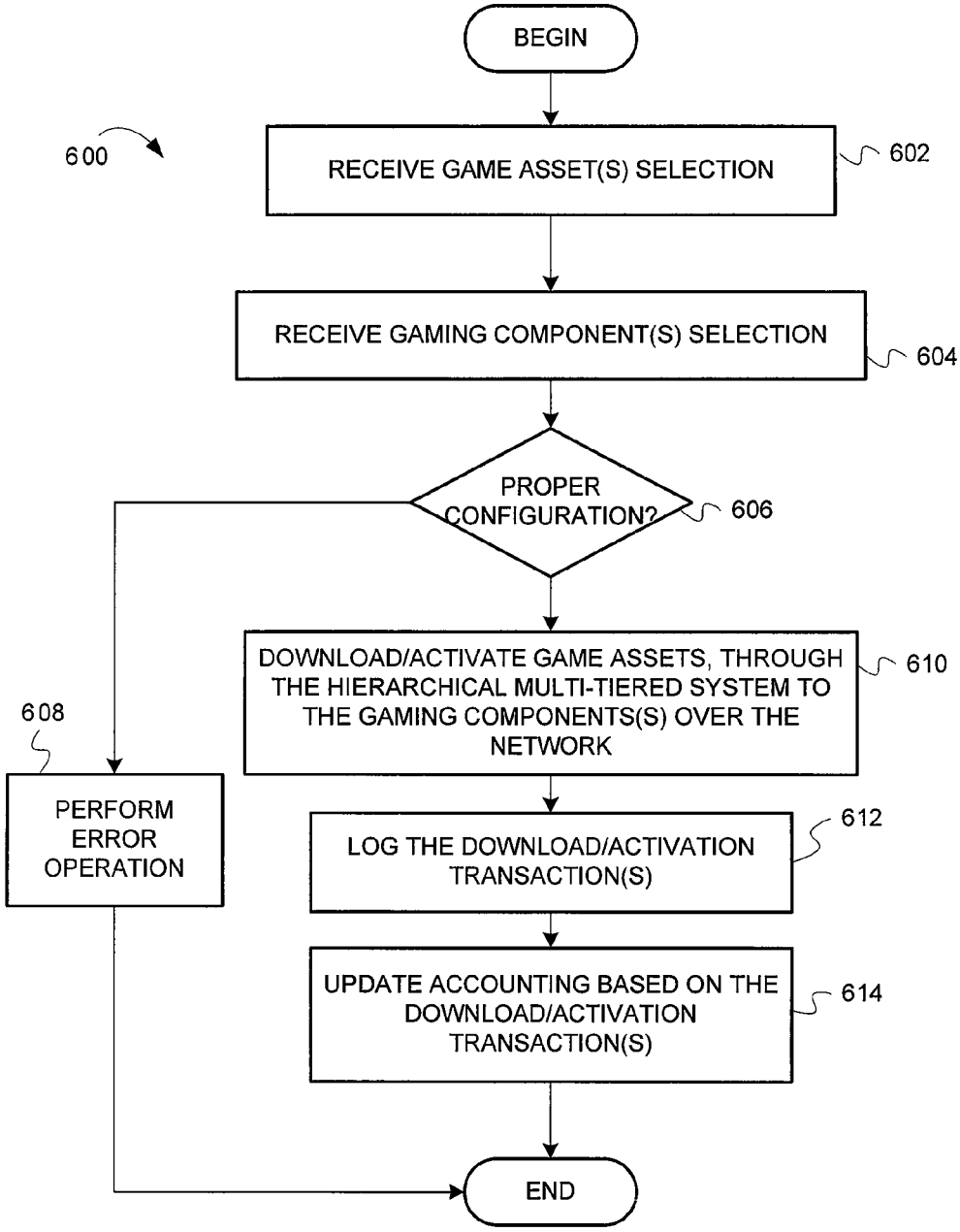
FIG. 6 illustrates a flow diagram for operations for distributing of game assets in a hierarchical multi-tiered system, according to some embodiments of the invention.
Figure 7:
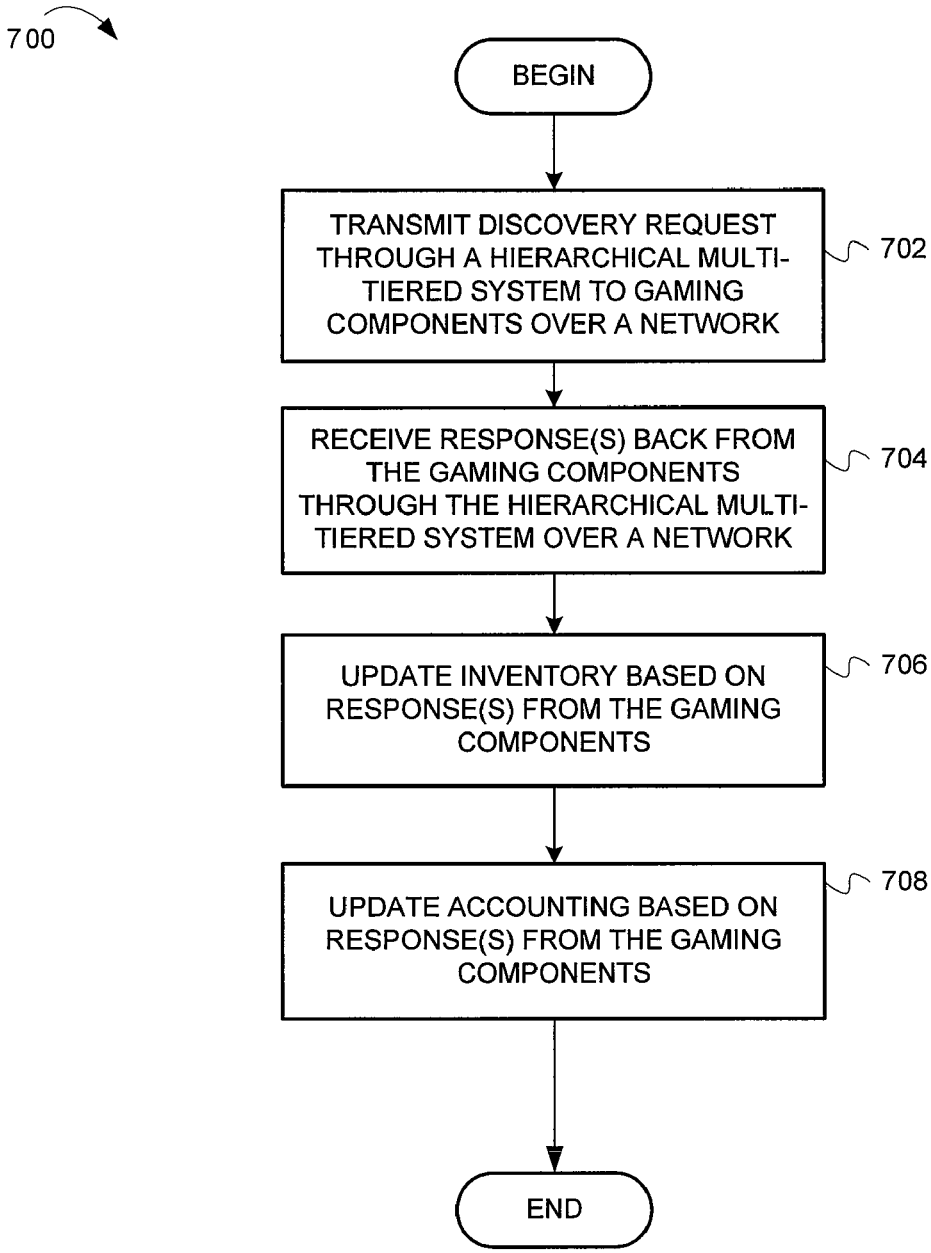
FIG. 7 illustrates a flow diagram for operations for discovering components of the gaming platform in a hierarchical multi-tiered system, according to some embodiments of the invention.
Figure 8:
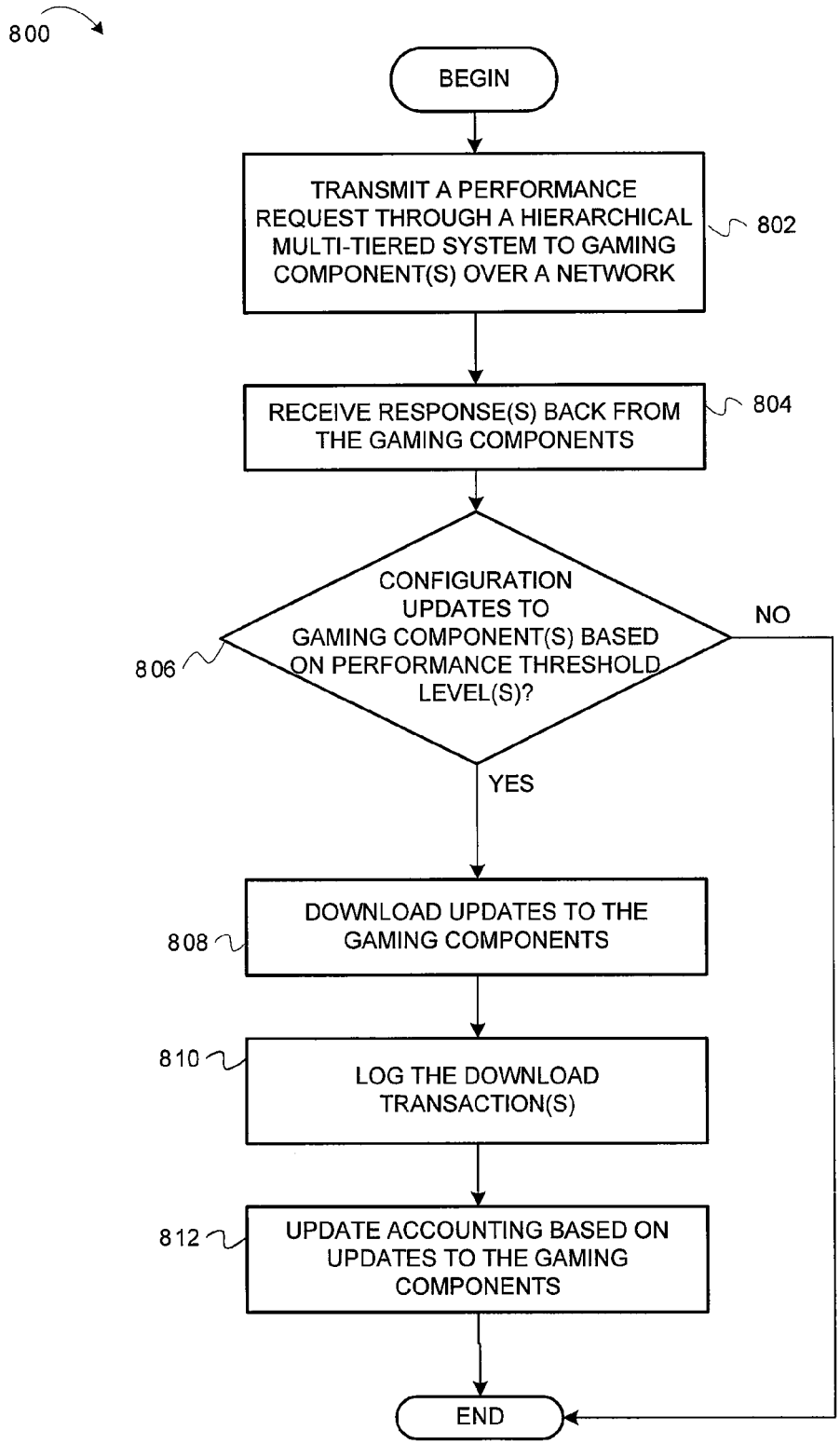
FIG. 8 illustrates a flow diagram for operations for configuration updates gaming components of the gaming platform in a hierarchical multi-tiered system based on performance management, according to some embodiments of the invention.

In this section, FIGS. 5-8 are discussed. In particular, FIGS. 5-6 describes operations for distributing configuration data/game assets to gaming components in a hierarchical multi-tiered system. FIG. 7 describes operations for discovering components of a gaming platform in a hierarchical multi-tiered system. FIG. 8 describes operations for performing configuration updates based on performance management in a hierarchical multi-tiered system. This description proceeds with a discussion of FIG. 5.

FIG. 5 illustrates a flow diagram for operations for distributing of configuration data to gaming components in a hierarchical multi-tiered system, according to some embodiments of the invention. The flow diagram 500 is described with reference to the central administration unit 204 performing the operations. However, other components of the systems platform may perform such operations. The flow diagram 500 is described with reference to FIGS. 1-2. The flow diagram 500 commences at block 502.

At block 502, a master configuration is transmitted, from the top of a hierarchical multi-tiered system, to one or more local gaming sites. In some embodiments, the central administration unit 204 may transmit the master configuration. The master configuration may restrict the choices available for configuration at the local gaming sites. The master configuration may be the same or different for some or all of the local gaming sites. Accordingly, the central administration unit 204 may broadcast a same master configuration to some or all of the local gaming sites.

The master configuration may include configuration parameters that include, but are not limited to, (1) percentages, (2) denominations, (3) enabling/disabling of specific games on a multi-game device, (4) initialization of certain bits in the memory of the gaming device to a pre-set value, (5) parameters typically configured in the administration screen of the gaming device, and (6) enabling/disabling bills on a bill acceptor of a gaming device.

For example, the master configuration may preclude the downloading of certain games to a particular local gaming site. The master configuration may limit the number of a particular type of game for a local gaming site. For example, the master configuration may require that only game A may only be downloaded into 15 different gaming components for the local gaming site. The master configuration may also limit that a particular game may be distributed within a defined number of banks of gaming machines, to individual games not associated with a bank, etc. The master configuration may require that game A cannot be distributed to a gaming machine that is within a given distance of a gaming machine that includes game B. For example, the master configuration may require that game A cannot be distributed to a gaming machine that is next to a gaming machine that includes game B. Further, the mater configuration may require that game C cannot be distributed to a gaming machine that is part of a bank of machines that has machines that may include game D.

In some embodiments, the site controller 214 may receive the master configuration and further distribute the configuration to other components further down in the gaming system hierarchy. Furthermore, the site controller 214 may further limit the configuration choices for these components. For example, the master configuration may require that a first bank of machines have a further limited choice of configuration (configuration A) and a second bank of machines have a different further limited choice of configuration (configuration B). Therefore, with reference to FIG. 2, the site controller 214 may limit the bank of machines 250 to configuration A and the bank of machines 252 to configuration B. Similarly, the site controller 214 may provide such limited configurations to the individual gaming components (e.g., gaming machines 232). The flow continues at block 504.

At block 504, configuration choices are received based on the master configuration. In some embodiments, the central administration unit 204 may receive these configuration choices. The central administration unit 204 may receive these configuration choices from one or more of the site controllers 214. The site controllers 214 are limited in their choices of configuration based on the master configuration received. The site controllers 214 may request configuration choices for individual gaming components, for a bank of such components, for all of the gaming components at the local gaming site 106, etc. For example, the site controller 214 may request certain percentages, denominations and/or specific games for certain gaming components. The site controllers 214 may aggregate the configuration choices provided by the gaming components at the lower part of the hierarchy. The site controllers 214 may require further communications with the lower part of the hierarchy to resolve configuration conflicts. For example, assume that a particular game may be distributed to a limited number of gaming machines. If a greater number of gaming machines request a particular game, the site controller 214 may deny a configuration for certain gaming machines. Further, the site controller 214 may request a different configuration choice. The site controller 214 forwards the configuration choices to the central administration unit 204. The flow continues at block 506.

At block 506, the selected configuration is downloaded through the gaming system hierarchy to the receiving gaming component. The central administration unit 204 may perform the download of the selected configuration. In part of the configuration, the central administration unit 204 may retrieve game assets from the central game asset store 208. The central administration unit 204 transmits the selected configuration to the site controllers 214. The site controllers 214 may then further distribute the selected configuration to the appropriate components, further down the hierarchy. This distribution is iteratively performed down the hierarchy until the configuration is received by the appropriate gaming component. The flow continues at block 508.

At block 508, the download transactions are logged. In some embodiments, the central administration unit 204 may log the download transactions. For example, the central administration unit 204 may log the download transactions in the central data store 206. In some embodiments, this logging operation in the central data store 206 may be performed for all transactions and accesses for each configuration operation. For example, the operations in each of the blocks of FIG. 5 may be logged. Therefore, after the master configuration is transmitted down the hierarchy, after the selected configuration is received, etc., the central administration unit 204 logs such transactions. The flow continues at block 510.

At block 510, the accounting is updated based on the selected configuration downloaded. In some embodiments, the central administration unit 204 may perform this update. With reference to FIG. 2, the central administration unit 204 may update the accounting data store 240. For example, if the selected configuration includes a number of new games, the central administration unit 204 may update the accounting to allow for proper payment for use of such games. The operations of the flow diagram 500 are complete.

In some embodiments, a user of the system may configure, initiate and activate the download of an asset to single/multiple gaming components (such as a gaming machine), a group of non-consecutive gaming components (such as gaming machines that are part of different local gaming sites, different banks at a same local gaming site, etc. FIG. 6 illustrates a flow diagram for operations for distributing of game assets in a hierarchical multi-tiered system, according to some embodiments of the invention. The flow diagram 600 is described with reference to the central administration unit 204 performing the operations. However, other components of the systems platform may perform such operations. The flow diagram 600 is described with reference to FIGS. 1-2. The flow diagram 600 commences at block 602.

At block 602, game asset(s) selection is received. In some embodiments, the central administration unit 204 may receive the game asset(s) selection. For example, a user of an interface for the central administration unit 204 may select one or more game asset(s), which are inputted into the central administration unit 204. The game asset(s) may include different games, parts of games, files related to games (such as library files supporting such games), patches to games already installed on a gaming component, an updated version of a game, etc. The flow continues at block 604.

At block 604, gaming device(s) selection is received. In some embodiments, the central administration unit 204 may receive the gaming component(s) selection. For example, a user of an interface for the central administration unit 204 may select one or more gaming component(s), which are inputted into the central administration unit 204. The gaming component(s) may include a single gaming machine, a bank of gaming machines, a controller of a bank of gaming machines (such as one of the controllers 222). In some embodiments, the central data store 206 may store a list of all installed gaming components and associated network addresses (e.g., Internet Protocol (IP) addresses). The central game asset store 208 may include a registry of available content (e.g., gaming assets) stored therein. The central data store 206 may also store data that controls what content is licensed and allowed for each gaming component. The flow continues at block 606.

At block 606, a determination is made of whether the configuration is proper. In some embodiments, the central administration unit 204 may make this determination. For example, the configuration may be proper based on the master configuration (as described above). As described above, certain configurations may limit the downloading of certain games to certain machines, local gaming sites, etc. In some embodiments, the central administration unit 204 may determine that the configuration is not proper based on the physical configuration of the gaming machine. For example, based on the cabinet and display designs of the gaming machine, the game asset may be not executable thereon.

In some embodiments, certain features of a game asset may be added or removed as part of the configuration. In particular, some jurisdictional mandates or restrictions may require that certain features of a game asset be part or not be a part of the installation and activation. If the configuration is not proper, the flow continues at block 608. Otherwise, the flow continues at block 610.

At block 608, an error operation is performed. In some embodiments, the central administration unit 204 may perform this error operation. For example, the central administration unit 204 may log an error in the central data store, return an error message to the user attempting to the configuration, etc. The operations of the flow diagram 600 are complete.

At block 610, the game assets (selected) are downloaded and activated through the hierarchical multi-tiered system to gaming component(s) (selected) over the network. The central administration unit 204 may perform this download and activation. The download of the game assets may include the transmission of the game assets to the selected gaming component(s). The activation of the game assets may include the retrieval and activation of a license for the game asset(s). The activation may enable the game asset(s) to be executed on the gaming component(s). In some embodiments, the user may configure the download and activation to be executed at a scheduled time. Alternatively, the user may configure the download and activation to be executed on-demand. In some embodiments, the download may be performed while the gaming component is operational. For example, the download may be performed while a player is playing the gaming machine, there is cash on the gaming machine, etc. However, in some embodiments, the activation may not be performed while the gaming component is operational.

In some embodiments, the data that is downloaded is encrypted and/or digitally signed. Accordingly, the gaming component(s) may verify the origin of the data through decryption and/or digital signatures. In some embodiments, if the download and activation of the data is not successful, the state of the gaming component(s) may be roll backed. For example, if a new version of a game is being downloaded and activated, the gaming component(s) may reinstall and reactivate the previous version.

In some embodiments, the central administration unit 204 may track the statuses of all downloads and activations while in-progress. For example, the statuses may be presented to a user through a text line for each device from a single view, graphical representation of each device, etc. The status may be depicted visually using color. Statues may include (1) initializing, (2) downloading, (3) download complete, (4) decrypting/authenticating, (5) download successful, (6) download failed, (7) asset activation successful, (8) asset activation failed, (9) rollback successful, and (1) rollback failed. In some embodiments, if the download and activation fails, the central administration unit 204 may generate an error message indicating where the process failed (and possible reasons). In some embodiments, the central administration unit 204 may notify the user that game assets have been successfully downloaded but have not begun the activation process within a pre-configured time period that was part of the configuration.

In some embodiments, the central administration unit 204 may allow the user to define and execute the actions (rules) to be taken based on the status of the download and activation. The actions may be applied within the context of a single operation and across a group of operations. As an example, a user may schedule two downloads to a gaming component. The first download is a printer driver and the second download is a game asset. The user may define an action stating that if the printer download has failed, the game asset is to not be downloaded. The flow continues at block 612.

At block 612, the download and activation transactions are logged. In some embodiments, the central administration unit 204 may log the transactions. For example, the central administration unit 204 may log the transactions in the central data store 206. In some embodiments, the user may select to view and print download and activation logs. Some examples of logs that the user may choose to view and/or print include (1) a single log, (2) a non-consecutive group of logs, (3) logs generated within a specified time period, etc. The flow continues at block 614.

At block 614, the accounting is updated based on the download and activations. In some embodiments, the central administration unit 204 may perform this update. With reference to FIG. 2, the central administration unit 204 may update the accounting data store 240. The central administration unit 204 may update the accounting to allow for proper payment for use of such game assets. The operations of the flow diagram 600 are complete.

While the flow diagram 600 is described with reference to download and activation that is initiated by a user of the system, embodiments are not so limited. In some embodiments, the gaming components may initiate such transactions. The central activation unit 204 may process multiple requests from multiple gaming components for downloads and activations. Accordingly, the operations described at blocks 606-614 may be performed.

FIG. 7 illustrates a flow diagram for operations for discovering components of the gaming platform in a hierarchical multi-tiered system, according to some embodiments of the invention. The flow diagram 700 is described with reference to the central administration unit 204 performing the operations. However, other components of the systems platform may perform such operations. The flow diagram 700 is described with reference to FIGS. 1-2. The flow diagram 700 commences at block 702.

At block 702, a discovery request is transmitted, over a network, to component(s) (that are part of the gaming platform) in a hierarchical multi-tiered system. In some embodiments, the central administration unit 204 may transmit this discovery request. In some embodiments, this discovery request is a broadcast communications. Alternatively, this discovery request is individual communications transmitted to intended parts of the multi-tiered system.

The central administration unit 204 may transmit this discovery request to a part or all of the hierarchical multi-tiered system. With reference to FIG. 1, the central administration unit 204 may transmit this discovery request to discover all components in all of the gaming component sites 106, all of the components at the gaming component site 106A, etc. In some embodiments, the central administration unit 204 may transmit the discovery request to a part of one of the gaming component sites. For example, with reference to FIG. 2, the central administration unit 204 may the discovery request to the controller 222A to determine if gaming machines have been added or removed from the bank of gaming machines 250.

The discovery request may be a request to discover gaming components and/or the configurations within the discovered gaming components. For example, the central administration unit 204 may transmit a request to determine how many banks of gaming machines at a gaming component site 106A. This discovery request may also request how many gaming machines are in each discovered bank. This discovery request may also request the configuration of one or more of the discovered gaming machines. For example, the central administration unit 204 may request the software and/or hardware configuration of a gaming machine. For example, the request may include which game is currently being played, which games are installed on the machines, the versions of such games, the version of the operating system, a list of all software components (with or without versions), etc. Further, the request may also include dates of installation of one or more of these software components. The request may also include the type of processor, the amount of memory, the size of the hard drive, the types of peripherals (printers, coin acceptors, etc.), etc. The flow continues at block 704.

At block 704, response(s) to the discovery request are received back from the components of the gaming platform in the hierarchical multi-tiered system. In some embodiments, the central administration unit 204 may receive these response(s). The flow continues at block 706.

At block 706, the inventory is updated based on the response(s) received back from the components. In some embodiments, the central administration unit 204 may perform this update. With reference to FIG. 2, the central administration unit 204 may update the central data store 206 based on the response(s). For example, the central administration unit 204 may store the number of gaming components at a gaming component site, the configurations of such components, etc. The central administration unit 204 may also update records in the central data store 206, which indicates that a discovery request was transmitted and which responses were received, the time and date of such communication, etc. In some embodiments, some or all of this data is cached into the appropriate local data stores 218. These response(s) may allow the determination of the devices in the system 100 and configurations thereof. For example, the user may search, filter, sort, and print reports on inventory, such as number of devices in system, total number of devices per device type, list of assets and asset versions resident on each device, etc. The flow continues at block 708.

At block 708, accounting is updated based on the response(s) received back from the components. In some embodiments, the central administration unit 204 may perform this update. The central administration unit 204 may update the accounting data store 240. For example, the central administration unit 204 may store data based the activity of certain games being played on the gaming machines. The operations of the flow diagram 700 are complete.

In some embodiments, this inventory may be used to update and/or provide notification to a user after critical and optional component updates are available. For example, the updates may be for critical updates for all components, optional updates for all components, critical and/or optional updates based on a component type, etc. In some embodiments, the central administration unit 204 may transmit updates (such as critical updates) to the components at the local gaming sites 212 after such updates are available.

FIG. 8 illustrates a flow diagram for operations for configuration updates gaming components of the gaming platform in a hierarchical multi-tiered system based on performance management, according to some embodiments of the invention. The flow diagram 800 is described with reference to the central administration unit 204 performing the operations. However, other components of the systems platform may perform such operations. The flow diagram 800 is described with reference to FIGS. 1-2. The flow diagram 800 commences at block 802.

At block 802, a performance request is transmitted, over a network, to component(s) (that are part of the gaming platform) in a hierarchical multi-tiered system. In some embodiments, the central administration unit 204 may transmit this performance request. The performance may be measured by a number of different criteria. For example, for a gaming machine, the performance may be measured by (1) the amount of coins inserted therein, (2) the net win, (3) the number of handle pulls, (4) the average bet, (5) the percent occupancy (usage), (6) time, (7) denomination, (8) meters, etc.

The request may be to one or more gaming components in the system. In some embodiments, this performance request is a broadcast communications. Alternatively, this performance request may be through individual communications transmitted to intended parts of the hierarchical multi-tiered system.

The central administration unit 204 may transmit this performance request to a part or all of the hierarchical multi-tiered system. With reference to FIG. 1, the central administration unit 204 may transmit this performance request to all components in all of the gaming component sites 106, all of the components at the gaming component site 106A, etc. In some embodiments, the central administration unit 204 may transmit the performance request to a part of one of the gaming component sites. For example, with reference to FIG. 2, the central administration unit 204 may the performance request to the controller 222A to determine the performance of the bank of gaming machines 250. The flow continues at block 804.

At block 804, response(s) to the performance request are received back from the component(s) of the gaming platform in the hierarchical multi-tiered system. In some embodiments, the central administration unit 204 may receive these response(s). The flow continues at block 806.

At block 806, a determination is made of whether configuration updates are to be made to the gaming component(s) based on performance threshold levels. In some embodiments, the central administration unit 204 may make this determination. The performance threshold levels may be configurable values. As described above, the performance may be based on a number of criteria. For example, if percent occupancy is below 50%, a determination may be made to switch the games, update to a different theme of the game, etc. In some embodiments, the determination may be based on multiple criteria. For example, the central administration unit 204 may use threshold levels for both a net win threshold level and with the average bet. If configuration updates are not to be made, the operations of the flow diagram 800 are complete. Otherwise, the flow continues at block 808.

At block 808, the configuration updates are downloaded to the gaming components through the hierarchical multi-tiered system. The central administration unit 204 may perform this download. In some embodiments, the user may configure the download to be executed at a scheduled time. Alternatively, the user may configure the download to be executed on-demand. In some embodiments, the download may be performed while the gaming component is operational. For example, the download may be performed while a player is playing the gaming machine, there is cash on the gaming machine, etc.

In some embodiments, the data that is downloaded is encrypted and/or digitally signed. Accordingly, the gaming component(s) may verify the origin of the data through decryption and/or digital signatures. In some embodiments, if the download is not successful, the state of the gaming component(s) may be roll backed. For example, if a new version of a game is being downloaded and activated, the gaming component(s) may reinstall and reactivate the previous version.

As described above, in some embodiments, the central administration unit 204 may track the statuses of all downloads. Also, the central administration unit 204 may allow the user to define and execute the actions (rules) to be taken based on the status of the download. The actions may be applied within the context of a single operation and across a group of operations. The flow continues at block 810.

At block 810, the download transactions are logged. In some embodiments, the central administration unit 204 may log the transactions. For example, the central administration unit 204 may log the transactions in the central data store 206. In some embodiments, the user may select to view and print download and activation logs. Some examples of logs that the user may choose to view and/or print include (1) a single log, (2) a non-consecutive group of logs, (3) logs generated within a specified time period, etc. The flow continues at block 812.

At block 812, the accounting is updated based on updates to the gaming component(s). In some embodiments, the central administration unit 204 may perform this update. With reference to FIG. 2, the central administration unit 204 may update the accounting data store 240. The central administration unit 204 may update the accounting to allow for proper payment for use of such game assets. The operations of the flow diagram 800 are complete.

A number of different download operations have been described. In some embodiments, the downloads may be prioritized. For example, the local gaming sites 106 and/or components therein may have a preferred order based on revenue, time of being a part of the system, etc. The priority may also be based on the level of the game on a given gaming component. For example, certain episodes of a game may have a higher priority. The priority may also be based on the criticality of the update. For example, an update to patch a peripheral to preclude the acceptance of counterfeit money may have a higher priority in comparison to the download of a new version of a game.

Figure 9:
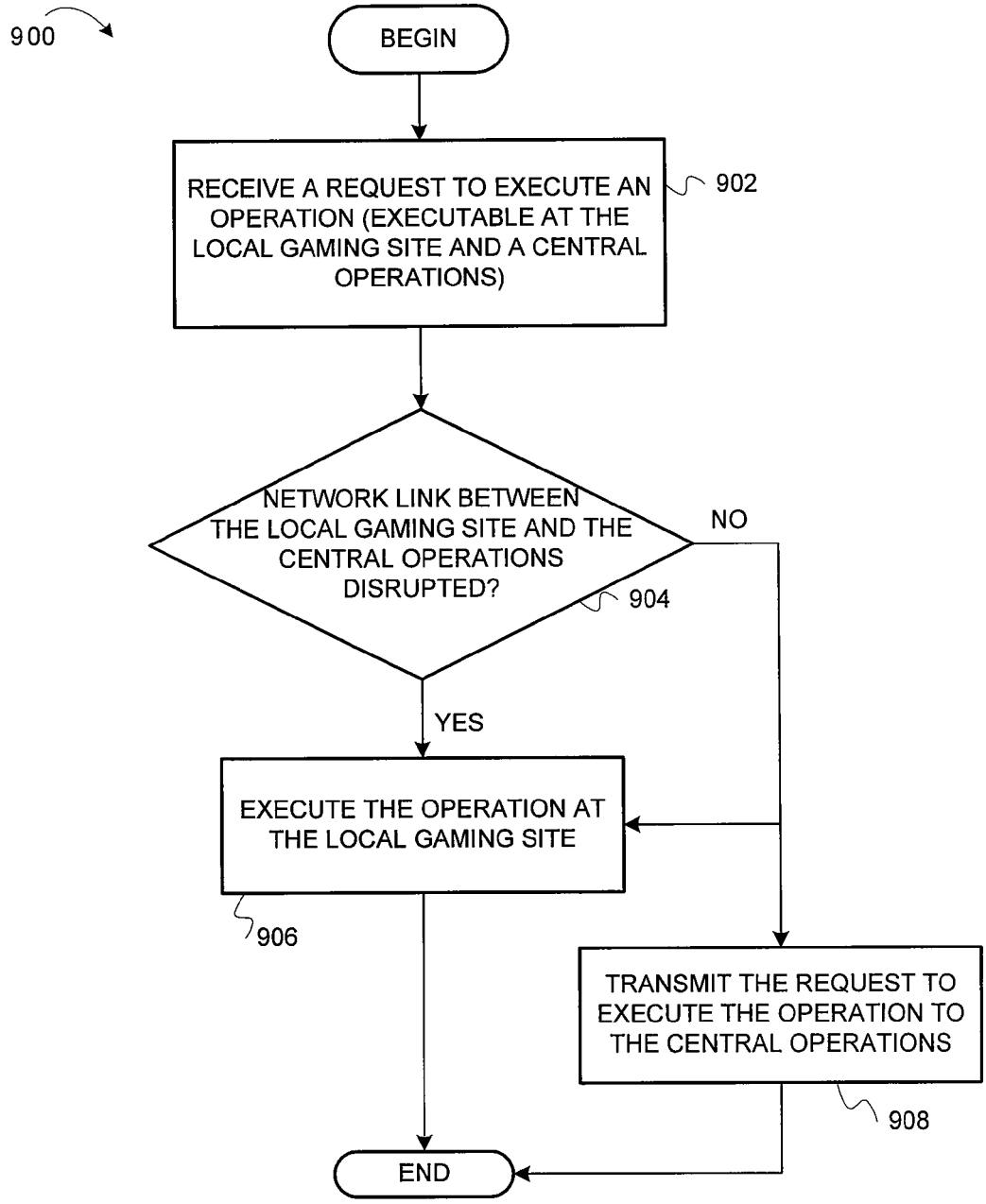
FIG. 9 illustrates a flow diagram for operations for executing an operation at the local gaming site or the central operations based on network availability, according to some embodiments of the invention.

FIG. 9 illustrates a flow diagram for operations for executing an operation at the local gaming site or the central operations based on network availability, according to some embodiments of the invention. The flow diagram 900 is described with reference to the site controller 214 performing the operations. However, other components of the systems platform may perform such operations. The flow diagram 900 is described with reference to FIGS. 1-2. The flow diagram 900 commences at block 902.

At block 902, a request to execute an operation (that is executable at a local gaming site or at a central operations) is received. In some embodiments, the site controller 214 may receive this request. For example, the request may be from a gaming machine at the local gaming site. In particular, the operation may include a request to retrieve data from one of the data stores. For example, the request may be to retrieve configuration data, games assets, etc. from the data store. The request may also be received from a scheduling operation. For example, a periodic update to the gaming machines may be performed. This periodic update may be typically performed by the central operations. Accordingly, if the update is not received by the site controller 214 at the scheduled time, the site controller 214 may execute this update operation. Other requests may include other administrative or maintenance operations as described herein (such as the discovery operations, synchronization operations, etc.). The flow continues at block 904.

At block 904, a determination is made of whether a network link between the local gaming site and the central operation is disrupted. In some embodiments, the site controller 214 may make this determination. The network link may be disrupted because of network problems at the local gaming site 212, at the central operations 210, in the network 234. If the network link is disrupted, the flow continues at block 906. Otherwise, the flow continues at block 906 or block 908.

At block 906, the operation is performed at the local gaming site. In some embodiments, the site controller 214 may perform this operation. For example, the site controller 214 may retrieve data from the local data store 218 or the local game asset store 220. The operations of the flow diagram 900 are complete.

At block 908, a request is transmitted to execute the operation at the central operations. In some embodiments, the site controller 214 may transmit this request. The component of the central operations 210 may then execute this operation. As shown, the operation may still be executed at the local gaming site 210 (at block 906). For example, in some embodiments, even if the network link is not disrupted, the site controller 214 may execute the operation (if possible). To illustrate, if the operation is to retrieve configuration data, the site controller 214 may attempt to access the data in the local data store or the local game asset store. If the data is not available, the site controller 214 may then transmit the request to the central operations 210. The operations of the flow diagram 900 are complete.

General

In this description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description. Moreover, in this description, the phrase "exemplary embodiment" means that the embodiment being referred to serves as an example or illustration.

Herein, block diagrams illustrate exemplary embodiments of the invention. Also herein, flow diagrams illustrate operations of the exemplary embodiments of the invention. The operations of the flow diagrams are described with reference to the exemplary embodiments shown in the block diagrams. However, it should be understood that the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may not perform all the operations shown in a flow diagram. Moreover, it should be understood that although the flow diagrams depict serial operations, certain embodiments could perform certain of those operations in parallel.

What is claimed is:

1. A method comprising:

transmitting a master configuration from a central operations of a hierarchical multitiered system to a local gaming site having a site controller and one or more gaming components, the master configuration having a first set of configuration parameters;

deriving by the site controller a second configuration from the master configuration, the second configuration having a second set of configuration parameters that further limit the first set of configuration parameters;

receiving, by the central operations, a selected configuration from the local gaming site, wherein the selected configuration is determined from the second configuration and wherein the selected configuration is determined by at least one of the site controller or the one or more gaming components; and downloading, from the central operations to the one or more gaming components, the selected configuration to the one or more of the gaming components through the hierarchical multi-tiered system.

2. The method of claim 1, further comprising logging the downloading of the selected configuration in a data store that is part of the central operations.

3. The method of claim 1, further comprising updating an accounting data store based on the downloading of the selected configuration.

4. The method of claim 1, further comprising downloading a digital certificate with the selected configuration, wherein the one or more gaming components authenticate the selected configuration based on the digital certificate.

5. The method of claim 1, further comprising:

executing an operation, by a component at the local gaming site, in response to a determination that a network link between the local gaming site and the central operations is disrupted, wherein the operation is executable by the component at the local gaming site and executable by a component at the central operations.

6. The method of claim 5, wherein executing the operation comprises downloading a game asset to one or more gaming machines at the local gaming site at a scheduled time.

7. The method of claim 5, wherein executing the operation comprises downloading an updated configuration to one or more gaming machines at the local gaming site.

8. The method of claim 5, further comprising receiving a request, from a gaming machine at the local gaming site, to execute the operation.

9. The method of claim 5, wherein executing the operation comprises:

retrieving configuration data from a local data store at the local gaming site; and transmitting the configuration data to a gaming machine at the local gaming site.

10. The method of claim 5, wherein executing the operation comprises:

retrieving a game asset from a local data store at the local gaming site; and transmitting the game asset to the gaming machine.

11. A system comprising:

a central data store to store a master configuration for a number of gaming components at a local gaming site having a site controller, the master configuration having a first set of configuration parameters; and a central administration unit to transmit the master configuration to the site controller for the local gaming site, wherein the site controller derives a second configuration from the master configuration, the second configuration having a second set of configuration parameters that further limit the first set of configuration parameters and further wherein the central administration unit is to receive, from the local gaming site, a selected configuration for at least one of the number of gaming components, wherein the selected configuration is determined from the second configuration and wherein the selected configuration is determined by at least one of the site controller or one of the number of gaming components.

12. The system of claim 11, further comprising a central game asset store to store a number of game assets to be installed on the number of gaming components, wherein the selected configuration is to include one of the number of game assets.

13. The system of claim 11, wherein the central administration unit is to download the selected configuration to the one of the number of gaming components.

14. The system of claim 11, wherein the central administration unit is to log the download of the selected configuration into the central data store.

15. The system of claim 11, wherein the central administration unit is to update accounting data in an accounting data store based on the selected configuration.

16. The system of claim 11, wherein the site controller executes a scheduled operation related to a gaming machine, if a network link between a central operations and the local gaming site is disrupted, wherein a component in the central operations is scheduled to execute the scheduled operation.

17. The system of claim 16, further comprising a local game asset store, wherein the scheduled operation is to download a game asset from the local game asset store to the gaming machine.

18. The system of claim 16, further comprising a local data store, wherein the scheduled operation is to download an updated configuration from the local data store to the gaming machine.

* * * * *

UNITED STATES PATENT AND TRADEMARK OFFICE

CERTIFICATE OF CORRECTION

PATENT NO. : 8,029,365 B2
APPLICATION NO. : 11/277064
DATED : October 4, 2011
INVENTOR(S) : Mary M. Burke et al.

It is certified that error appears in the above-identified patent and that said Letters Patent is hereby corrected as shown below:

In column 3, line 29, delete “pare” and insert -- part --, therefor.

Signed and Sealed this
Third Day of January, 2012

David J. Kappos

David J. Kappos
*Director of the United States Patent and Trademark Office*